United States Patent [19]

Smith

[11] Patent Number: 4,949,705

[45] Date of Patent: Aug. 21, 1990

[54] FIREPLACE STARTING APPARATUS

[76] Inventor: T. Randolph Smith, 4316 Grassmere La., Dallas, Tex. 75205

[21] Appl. No.: 258,258

[22] Filed: Oct. 14, 1988

[51] Int. Cl.[5] ..... F24C 3/00

[52] U.S. Cl. ..... 126/512; 431/264; 126/25 B; 126/503

[58] Field of Search ..... 126/521, 503, 92 R, 126/92 C, 39 R, 39 E, 39 C, 25 B; 431/264, 125, 154, 354

[56] References Cited

U.S. PATENT DOCUMENTS

| | | | |
|---|---|---|---|
| 2,007,292 | 7/1935 | Carleton | 126/512 |
| 2,319,721 | 5/1943 | Coker | 126/512 |
| 3,200,875 | 8/1965 | Cramer | 431/264 |
| 3,696,801 | 10/1972 | Whitehead | 126/512 |
| 4,626,196 | 12/1986 | Stohrer, Jr. | 431/264 |
| 4,726,351 | 2/1988 | Whittaker et al. | 126/512 |
| 4,779,608 | 10/1988 | Smith | 126/512 |

*Primary Examiner*—James C. Yeung
*Attorney, Agent, or Firm*—Crutsinger & Booth

[57] ABSTRACT

In accordance with the invention, a fireplace starting apparatus is provided which includes a control valve for controlling the flow of flammable gas to a fireplace burner, with said control valve being adapted for permanent installation in a structure external of and adjacent to a fireplace. Said apparatus includes a conduit connectable at one end to a fireplace burner within the fireplace and at the other end to the control valve. In one embodiment, the device may be provided with a remotely operable ignition/reignition device including an igniter mountable adjacent the burner within the fire box, an actuator located adjacent to the control valve and means operably connecting the actuator to the igniter. A sensor adjacent to the igniter may detect the absence of a flame and cause the igniter to light the gas flame upon startup and also during operation of the gas flame is extinguished while the gas is still flowing. The device may include provision for both a gas conduit to the burner and electrodes for the igniter and the sensor to pass through one knockout hole in the fireplace.

40 Claims, 6 Drawing Sheets

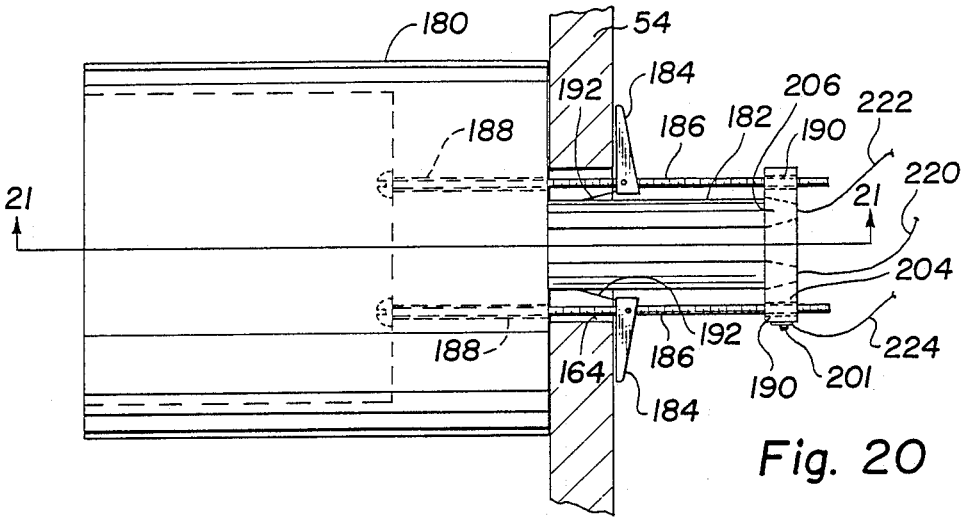
Fig. 20
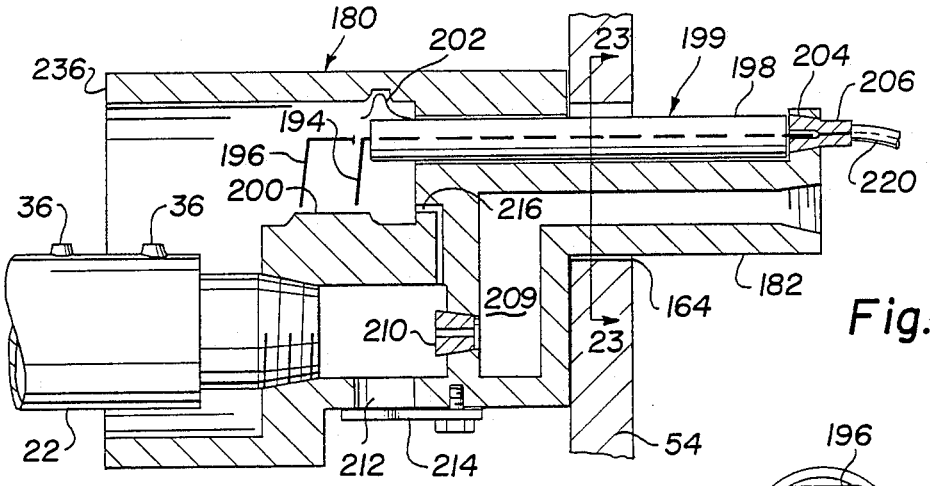
Fig. 21
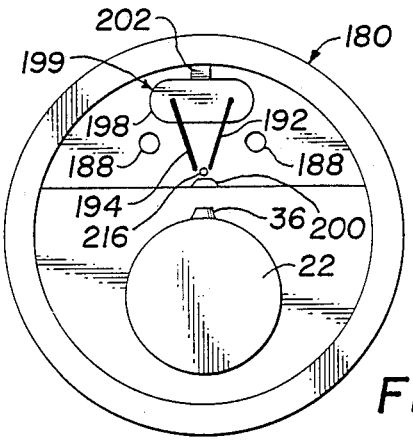
Fig. 22
Fig. 23
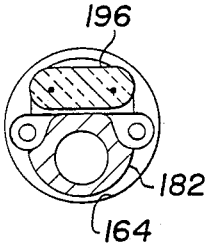
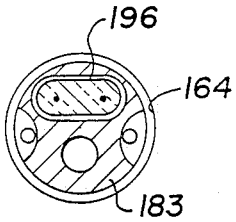
Fig. 26

FIREPLACE STARTING APPARATUS

This invention relates generally to a gas fueled device for creating a fire in a fireplace and more particularly concerns a self igniting, gas fueled device for permanent installation in a fireplace and which may include a reignition apparatus.

BACKGROUND OF THE INVENTION

Heretofore, some homes and other buildings having fireplaces have been provided with fireplace starting devices which have been supplied with flammable gas fuel by connection to a household gas supply such as a natural gas utility or a fixed, refillable LPG tank. Such devices have commonly included a permanent connection from the home's gas meter or tank to the inlet of a permanently installed, dedicated on/off valve usually located immediately adjacent the fireplace. A second permanently installed conduit connects the outlet of such valve to the fireplace, where a gas burner is connected to the second conduit either by rigid or flexible conduit. Such conduit may pass through the single knockout hole, commonly a round hole about one inch (25 mm) in diameter, that is commonly provided for that purpose in the sidewall of many preassembled fireplaces. Such burner may be located beneath a log grate within the fireplace.

In operation, after wood logs or other combustible materials or non-combustible artificial logs are placed upon the log grate, the gas valve is opened and the flammable gas flowing through and out of the burner within the fireplace is ignited, as by a match or butane lighter. If logs or other combustible material have been used, the gas supply to the burner may be turned off at the valve after they have ignited. If artificial logs are used, the valve may be turned off when a flame is no longer desired.

Such permanently installed and connected devices as described above suffer from significant disadvantages. The gas used is flammable and can fill a room if allowed to flow into the fireplace in the absence of a flame. Such devices include no means for igniting the gas, requiring the user to provide an ignition device such as a match or handheld butane lighter. Such devices also include no means for insuring that the gas is ignited initially or for reigniting the gas should the flame be extinguished while the gas supply valve remains open. The device described requires connection to a household gas supply, a connection which is in itself expensive and requires service from a natural gas utility or a fixed, refillable LPG tank. Additionally, such devices as described make no provision for the storage of fireplace tools or accessories or emergency devices such as a fire extinguisher.

At least one of these objections has been overcome by the provision of portable fireplace starting devices fueled by replaceable propane canisters. Such devices have included a unitary device having a burner, a conduit connecting the burner to the replaceable canister, and the canister itself. Although such devices may be used in homes lacking a natural gas utility connection, they suffer additional disadvantages including the need to remove the hot, dirty, ash covered burner from the fireplace for storage between uses. This particular disadvantage has been overcome by my co-pending application, U.S. Pat. No. 4,779,608, issued Oct. 25, 1988, which provides a two-piece fireplace starter in which the burner may remain in the fireplace, permanently attached to the grate, while a portion of the conduit and the replaceable canister may be disconnected therefrom and stored. However, even this improved device contains the disadvantage of all such devices in requiring that at least a portion of the starter be separately stored away from the fireplace and retrieved for each use, as well as providing no ignition or reignition device.

Therefore, it is an object of this invention to provide a fireplace starting apparatus which may be permanently installed and which may include a flame ignition device capable of igniting the flammable gas within the fireplace, which flame ignition device may be remotely operable from outside the fireplace.

It is a further object of this invention to provide a self-igniting fireplace starter device which may also be used to provide a flame for artificial logs and gas fireplaces.

It is a further object of this invention to provide a flammable gas fireplace starting apparatus in which the gas is automatically ignited when the gas supply valve is opened.

It is a further object of this invention to provide a flammable gas fireplace starter in which the gas is automatically reignited if the flame is extinguished while the gas valve remains open.

It is a further object of this invention to provide a fireplace starter apparatus in which both the gas supply conduit to the burner and the ignition/reignition control means may enter the fireplace through the single knockout hole commonly provided in preassembled fireplaces.

It is a further object of this invention to provide a fixed fireplace ignition apparatus which may be permanently installed and may be used in a home that lacks a household gas supply.

It is a further object of this invention to provide a fireplace starting apparatus in which the burner and controls may be permanently installed in a home and which may be fueled by portable replaceable or refillable canisters of flammable gas either interior of or exterior of the home.

SUMMARY OF THE INVENTION

In accordance with the invention, a fireplace starting apparatus is provided which includes a control valve for controlling the flow of flammable gas to a fireplace burner, with said control valve being adapted for permanent installation in a structure external of and adjacent to a fireplace. Said apparatus includes a conduit connectable at one end to a fireplace burner within the fireplace and at the other end to the control valve. In one embodiment, the device may be provided with a remotely operable ignition/reignition device including an igniter mountable adjacent the burner within the fire box, an actuator located adjacent to the control valve and means operably connecting the actuator to the igniter. A sensor adjacent to the igniter may detect the absence of a flame and cause the igniter to light the gas flame upon startup and also during operation if the gas flame is extinguished while the gas is still flowing. The device may include provision for both a gas conduit to the burner and electrodes for the igniter and the sensor to pass through one knockout hole in the fireplace.

BRIEF DESCRIPTION OF THE DRAWINGS

Other objects and advantages of the invention will become apparent upon reading the following detailed description and upon reference to the drawings in which:

FIG. 17 is a sectional view of the mount of

FIG. 16 taken along line 17—17 of FIG. 16.

FIG. 20 is a top view of another embodiment of the fireplace starter of the invention that includes both an igniter and a flame sensor.

FIG. 21 is a partial sectional view taken along line 21—21 of FIG. 20.

FIG. 22 is an end view of the fireplace starter of FIG. 20.

FIG. 23 is a sectional view taken along line 23—23 of FIG. 21.

FIG. 26 is an alternative embodiment of the portion of the fireplace starter shown in FIG. 23.

While the invention will be described in connection with a preferred embodiment, it will be understood that the description is not intended to limit the invention to that embodiment. On the contrary, the invention is intended to cover all alternatives, modifications and equivalents as may be included within the spirit and scope of the invention as defined by the appended claims.

DETAILED DESCRIPTION OF THE INVENTION

Figure 1:
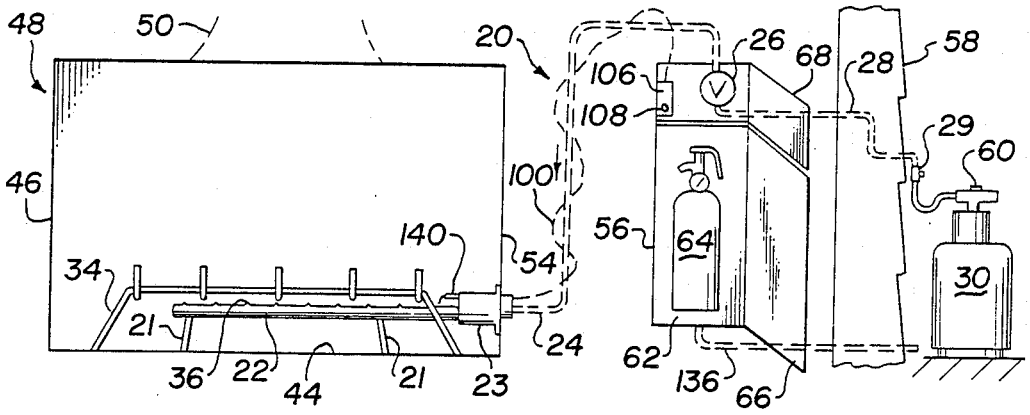
FIG. 1 is an elevation of one embodiment of the fireplace starting apparatus of the invention.
Figure 15:
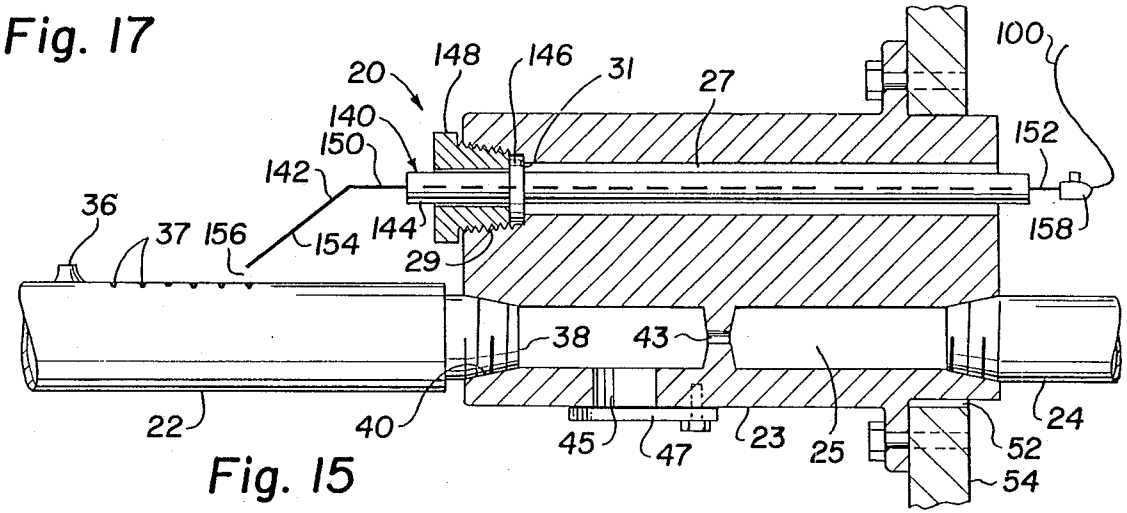
FIG. 15 is a partial sectional view of a portion of the fireplace starter of FIG. 1.

Turning first to FIGS. 1 and 15, there is shown one embodiment of the fireplace starting apparatus 20 of the invention. The apparatus 20 includes a burner 22, which is connected through a mount 23 to a conduit 24, which is in turn connected to a valve 26, which is in turn connected to a second conduit 28, which is in turn connected to a source of flammable gas such as replaceable canister 30 containing flammable gas though permanently installed regulator 32. Alternatively, the second conduit may be connected to a household gas supply such as a fixed, refillable LPG tank or a natural gas utility. The burner 22 used is conventional; it may be, as shown, a cast burner having individual gas jets 36 in the surface thereof and a threaded opening 38 at one end for connection to the gas supply. Alternatively, the gas supply opening may be located centrally in the burner or the burner may be a length of pipe having openings drilled or cut into it for the escape of gas therewithin. Alternatively, the burner may be embedded in the hearth 44 of the firebox 46. The burner 22 may be attached to a log grate 34 as by clamps or supported by legs 21 or it may rest directly on the hearth 44 or it may be self supporting through connection to the gas supply opening 38, as shown in FIGS. 1 and 15.

The burner 22 is located within the confines of a fireplace 48, as shown in FIG. 1. The burner 22 is typically located beneath the log grate 34 and above the hearth 44 upon which the log grate 34 rests, within the firebox 46 of the fireplace 48 and beneath the flue 50 thereof. The interior of the firebox 46 is a harsh environment, subjecting the fireplace starting apparatus 20 to continuous high heat, corrosive gases and the possibility that heavy logs may be dropped or fall upon the apparatus 20.

As shown in FIGS. 1 and 15, the burner 22 is connected to a rigid conduit 24 by a threaded end 40 about the gas supply opening 38 of the burner and by a mount 23 having a passage 25 therethrough. Mount 23 may include an internal orifice 43 in the passage 25. Mount 23 may also include an air mixing port 45 downstream of orifice 43, which port may be adjusted by cover 47. Mount 23 passes through an opening such as a hole 52 in the side wall 54 of the firebox 46 and into the interior of the building wall of the structure adjacent the fireplace 48. Hole 52 may typically be a knockout in the wall of a metal firebox 46, commonly a one inch (25 mm) diameter circular hole. Alternative, hole 52 may be a hole in the wall of a masonry firebox. Said conduit 24 is attached to mount 23 within the building wall where it continues to a box 56 permanently mounted within the wall as shown in FIG. 1. The conduit 24 may be either rigid, as shown in FIG. 1, or flexible, in accordance with local code requirements.

The conduit 24 enters the box 56 wherein it is connected to the outlet of control valve 26. As shown in FIG. 1, control valve 26 is an on-off gas valve which may incorporate a variable orifice so as to vary the flow rate of gas through the valve 26 to the fireplace burner 22. The inlet of the control valve 26 is connected to a second conduit 28 which exits from the box 56 into the wall of the structure surrounding the box 56 and passes therethrough to the exterior of the structure 58 which comprises the home or other building containing the fireplace 48. There, the second conduit 28 is fitted with a permanently installed regulator 32 and connected to a replaceable canister of flammable gas, such as the refillable, twenty pound gas cylinder 30 shown in FIG. 1. The replaceable cylinder 30 is preferably also fitted with a regulator 60 in conformance with accepted practice and codes and manufacturers' instructions. Alternatively, the second conduit 28 may be connected to a household gas supply such as a large, permanently installed, refillable tank or a gas utility.

The box 56 shown in FIG. 1 may also include a storage volume 62 located adjacent the valve 26. Said storage volume 62 is sufficient in size to hold a conventional residential fire extinguisher 64, as shown, or a chimney fire extinguisher or a set of fireplace tools or other fireplace accessories. The storage volume 62 is provided with a hinged door 66 which provides access thereto. The box 56 is further provided with a second hinged door 68 which provides access to the control valve 26 for the manual operation thereof. Alternatively, a single door may be used.

The fireplace starting apparatus 20 of FIG. 1 further includes an ignition device for igniting the flammable gas as it exits from the burner 22 into the firebox 46 within the fireplace 48. Said ignition device includes an igniter 140 which is mounted adjacent to the burner 22 as shown in FIG. 15. The igniter 140 comprises an elongated metallic electrode 142 surrounded by an insulator 144 which is fixed to the electrode 142 and is preferably alumina ceramic. The external cylindrical contours of the insulator 144 include a circular flange 146. Alternatively, a glow plug igniter may be used.

The igniter 140 is mounted to the mount 23 adjacent to the burner 22. The igniter 140 is inserted into a passage 27 through the mount 23 until the circular flange 146 bears against an internal shoulder 31 of the passage 27. The igniter 140 is retained therein by a hollow bolt 148 which is threaded into a threaded end 29 of the passage 27 and bears against the flange 146 as shown in FIG. 15.

Figure 19:
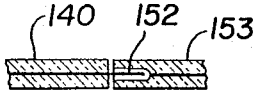
FIG. 19 is a sectional view of the igniter of the invention fitted with an extension.
Figure 24:
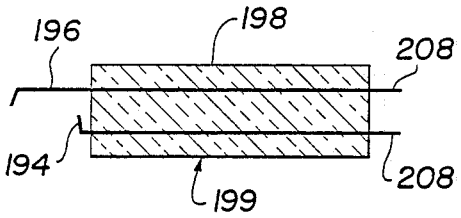
FIG. 24 is a top sectional view of the electrode unit of FIGS. 21–23.

The igniter 140 and the insulator 144 thereof may be of a length great enough to extend completely through the passage 27 of the mount 23 and to extend beyond the surfaces of the mount 23 at both ends of the passage 27 therethrough, as shown in FIG. 15. The continuous electrode 142, which is surrounded by the insulator 144, may extend beyond the ends of the insulator 142 at both the sparking end 150 and the connecting end 152 of the igniter 140. Additional sections 153 of the continuous electrode 140 may be connected at the connecting end 152, as shown in FIG. 19. The electrode extension 154 at the sparking end 150 is formed so as to come into close contact with the burner 22, leaving only a predetermined air gap 156 therebetween.

In operation of the ignition device, a spark bridges the air gap 156, thereby igniting flammable gas flowing from the gas jets 36. In the burner 22 of FIG. 15, it can be seen that smaller gas jets 37 may be provided near the air gap 156 and that the larger gas jets 36 of the burner 22 are located in the portion of the burner 22 located distant from the exterior walls 54 of the firebox 46 closer to the middle of the firebox 46, as seen in FIG. 1. The smaller gas jets 37 serve to carry the flame from the air gap 156 of the igniter 140 to the larger gas jets 36, which provide heat and flame sufficient to ignite logs or other flammable material in the log grate 34 yet are distant from the exterior walls 54.

An insulated wire 100 is electrically connected to the connecting end 152 of the electrode 142 by an insulated connector 158. Insulated wire 100 is provided with sufficient slack to allow the electrode 140 to be withdrawn from the mount 23 with the wire 100 attached after the hollow bolt 148 is removed. In this manner, the electrode 140 can be conveniently replaced if damaged.

Figure 16:
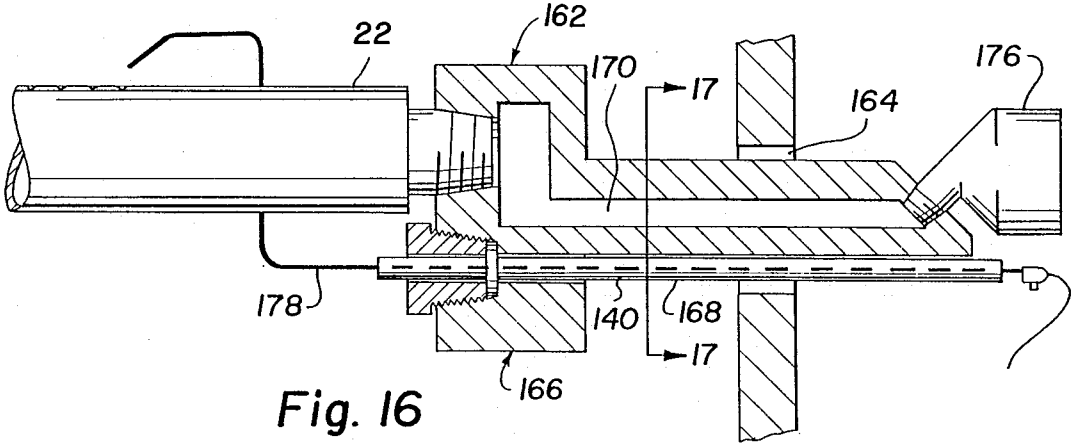
FIG. 16 is a sectional view of an alternative mount of the fireplace starter.
Figure 17:
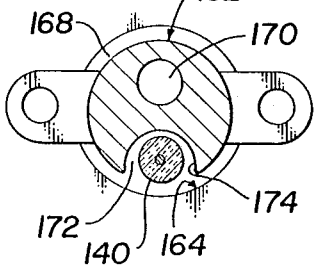

An alternative mount 162, shown in FIGS. 16 and 17, is preferred for use in fireplaces such as prefabricated fireboxes that are provided with a single knockout hole 164 in the side of the firebox. The knockout hole 164 is often a one inch (25 mm) diameter circular hole sized to fit closely about the exterior of a piece of ½" nominal (13 mm) pipe, which has an outside diameter slightly smaller than one inch (25 mm). As shown in FIG. 17, the mount 162 will fit through a knockout hole 164.

The same burner 22 and the same igniter 140 may be connected to the head 166 of the mount 162 in the same manner that they are connected to the mount 23. The mount 162 is provided with a neck portion 168. The neck portion 168 contains a passage 170 for the flammable gas and also provides space 172 for the igniter 140 to pass through the knockout hole 164. The space 172 may be, but need not be, completely encircled by the neck portion 168. Wing portions 174 may be provided adjacent to the space 172 to protect the relatively more fragile ceramic insulation of the igniter from contact with the edges of the knockout hole 164. A pipe fitting 176 adapts the passage 170 for connection to the conduit 24.

Figure 18:
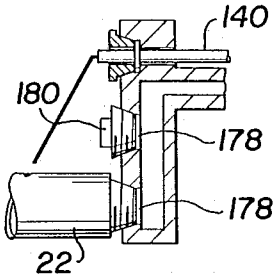
FIG. 18 is a side view of an alternative mount.

As may be seen in FIG. 16, the centerline of the burner 22 is offset from the centerline of the neck 168. This offset permits adjustment of the height of the burner 22 above the hearth 44 through rotation of the mount 162. The igniter 140 may be provided with an electrode 178 shaped to accommodate the rotation of the mount 162. As shown in FIG. 18, an even greater range of height adjustment may be provided by providing two alternative burner connections 178 and plugging the connection 178 not used as by plug 180.

The fireplace starter shown in FIGS. 20-25 provides automatic ignition of the gas flame and automatic reignition of the gas flame if it should be extinguished while the gas supply valve remains open.

FIGS. 20 and 21 show a mount 180 attached to firebox sidewall 54. A neck 182 of mount 180 passes through a single knockout hole 164 in the sidewall 54, which hole 164 may be about 1" (25 mm) in diameter. The mount 180 attached to the sidewall 54 by a two single spring-loaded toggle-bolt wings 184 which are drawn tight by long, threaded screws 186 passing though unthreaded holes 188 and 190 of the mount 180. Each wing 184 and screw 186 combination is a conventional spring loaded toggle-bolt with one of the wings removed and with one end of the spring 192 thereof bearing upon the neck 182 instead of upon the removed wing. The neck 182 may thus be inserted throughout the knockout hole 164 and the mount 180 fastened to the firebox sidewall 54 by tightening the screws 186 without requiring access to the back side of the sidewall 54. The mount 180 may later be removed by removing screws 186, allowing the replaceable wings 184 to drop off.

The ignition/reignition function requires two insulated electrodes 194 and 196 and a ground. Each electrode may be a ceramic-insulated igniter 140 as shown in FIG. 15. Alternatively, the two insulated electrodes 194 and 196 may be enclosed by a single ceramic insulator 198 into a replaceable unit 199 as shown in FIGS. 20–24. In FIGS. 21 and 22, the necessary ground 200 is provided by the mount 180. The electrodes 194 and 196 and the ground 200 are spaced so that the gap between each electrode and the ground is smaller than the minimum gap between the two electrodes. Alternatively, ground may be provided by a third electrode. All three electrodes may be incorporated into the same unit, with the ground electrode preferably located between the other two electrodes. The electrical unit 1 99 is retained in the mount 180 by a clip 202. Depressing the clip as by a screwdriver allows the electrode unit 199 to be withdrawn and replaced if desired. The mount 180 is provided with a buttress 204 to retain insulated wire end connectors 206 which engage projecting ends 208 of the electrodes 194 and 196. The mount is also provided with a shield 236 that extends around the electrodes to protect them as from heavy falling logs.

FIG. 26 shows an alternative neck 183 in which the electrode unit 199 is completely enclosed with the neck 183.

The mount 180 and the neck 182 thereof also include a passage 209 for providing gas to the burner 22. The mount 180 is also provided with a replaceable orifice 210 and an air mixing port 212 with movable cover 214. A separate gas jet 216 blows a narrow plume of gas through the gaps between the igniter electrode 194 and ground 200 and between the sensor electrode 196 and ground 200. A spark jumping from the igniter electrode 194 to ground 200 will ignite the gas plume and cause it to burn, which in turn will ignite gas flowing from the burner jets 36. The gas plume will also burn in the vicinity of the gap between the sensor electrode 196 and ground 200.

The igniter operates in a known manner by creating a spark from the igniter electrode 194 to ground 200. As is known, flame is more electrically conductive than air, flammable gas or a mixture of them. Thus, the sensor also operates in a known manner by detecting current flow from the sensor electrode 196 to ground 200 in the presence of a flame.

Figure 25:
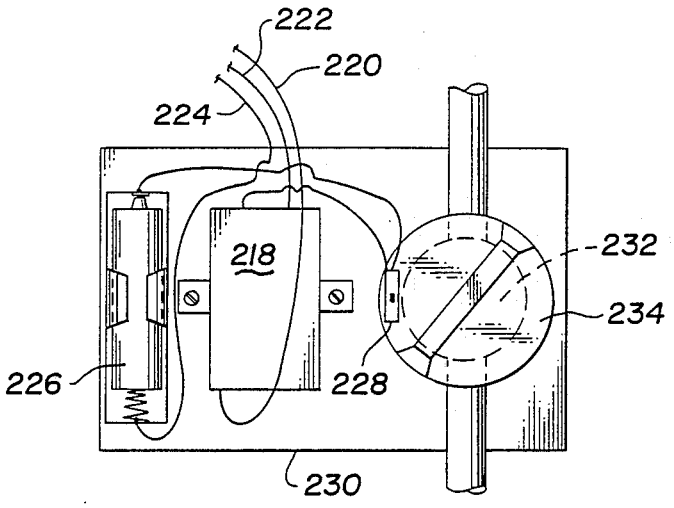
FIG. 25 is a front view of the control box for the embodiment of FIGS. 21–24.

As shown in FIG. 25, the fireplace starter is operated from a control box 230, which includes a valve 232 and a control module 218 such as an NTK BSN-110 manufactured by the NGK Spark Plug Co., Ltd. Igniter lead 220, sensor lead 222 and ground lead 224 connect the control module through wire connectors 206 to the igniter electrode 194, sensor electrode 196 and ground terminal 201, respectively. Alternatively, ground may be provided through a metallic gas supply conduit 24. The control module 218 is powered either by a battery 226 or by household current. It is actuated by a momentary-contact push-button switch 228.

The valve 232 supplies flammable gas through the mount 180 to the burner 22. The valve is a spring loaded push in and then turn type. The operator must push the valve knob 234 in before the knob can rotate to turn the valve 232 on. The valve knob 234 remains depressed while rotated to the "on" position and pops up only when rotated by the operator back to the "off" position. The switch 228 is located beneath the knob 234. The switch 228 is closed whenever the knob 234 is depressed. Thus, the ignition/reignition system is on whenever the gas is on.

In operation, when the gas valve 232 is first turned on by depressing and then rotating the knob 234, the control module 218 detects the absence of a flame at the sensor electrode 196 and therefore causes the igniter electrode 194 to spark to ground 200. At the same time, the opening of the gas valve 232 causes a gas plume to flow from jet 216 past the spark, where the plume is ignited. The increased electrical conductivity of the flame allows a current to pass from the sensor electrode 196 to ground 200. Detection of this current flow causes the control module 218 to halt the sparking so long as the current continues to flow. Should the flame be extinguished while the switch 228 is still closed by the gas valve knob 234, then the current will cease flowing, causing the control module 218 to begin sparking until flame once again allows a current flow. Turning off the gas valve 232 and thereby opening the switch 228 deactivates the igniter.

Figure 13:
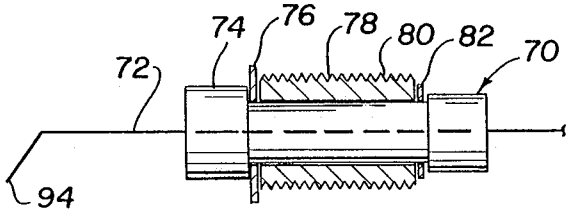
FIG. 13 is a partial sectional view of an alternative igniter.
Figure 14:
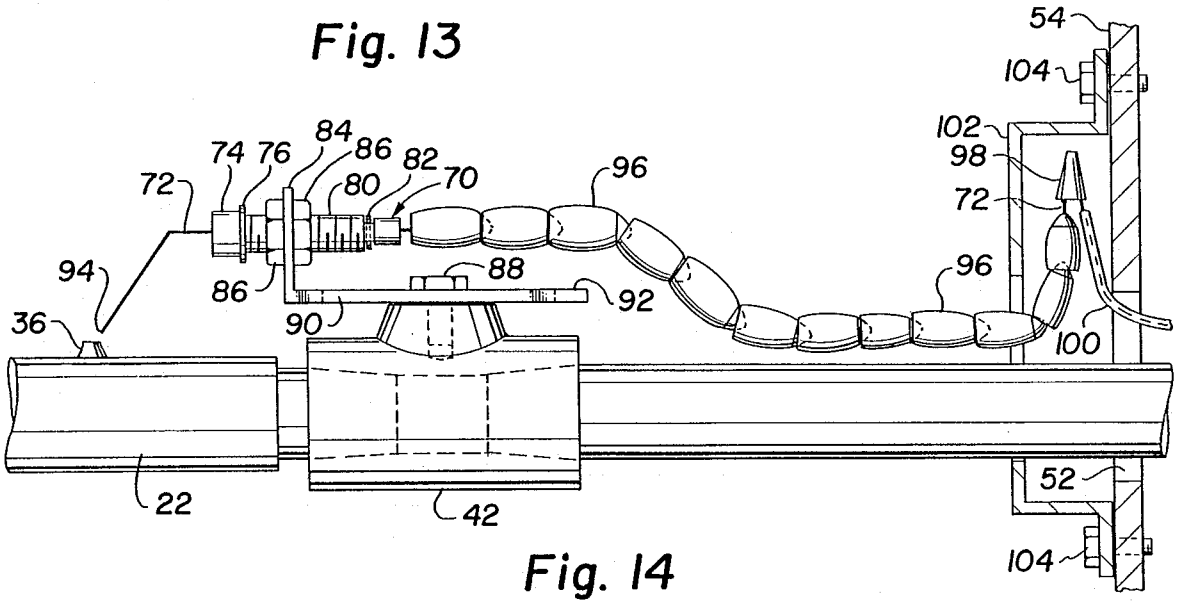
FIG. 14 is a partial elevational view of a fireplace starter including the alternative igniter of FIG. 13.

FIGS. 13 and 14 depict an alternative igniter 70, which may be mounted adjacent to the burner 22. The igniter 70 comprises an elongated metallic electrode 72 surrounded by an insulator 74 which is fixed to the electrode 72 and is preferably made of an alumina ceramic. The external cylindrical contours of the insulator 74 permit a washer 76 and a hollow tube 78 having a threaded exterior 80 to be placed about the insulator 74 and retained thereon by a clip 82.

The igniter 70 may be placed through a hole in an L-bracket 84 and fixed therein by nuts 86 on opposite faces of the L-bracket 84. The length of the exteriorly threaded tube 78 permits a measure of adjustment of the horizontal position of the igniter 70. Additional horizontal adjustment of that position is provided by a longitudinal slot 90 in the horizontal leg 92 of the L-bracket. The horizontal leg 92 of the L-bracket is attached to the pipe union 42 by bolt 88. Through the adjustment of the nuts 86 and the slot 90, the tip 94 of the electrode 72 can be adjusted so that it is immediately adjacent one of the gas jet openings 36 of the burner 22, so that a spark thrown from the tip 94 to the burner 22 will ignite flammable gas emerging from the gas jet 36.

The electrode 72 continues from the insulator 74 on the opposite side of the insulator 74 from the tip 94. Hollow beads 96 are placed about the continuous electrode 72 to provide high temperature electrical insulation to the electrode 72. The beads 96 are preferably ceramic. One end of each such bead 96 is provided with a convex surface which fits into the concave surface of the other end of each adjacent bead 96 so as to form a substantially continuous, high temperature electrical insulation about the electrode 72. This substantially continuous insulation is provided about the electrode 72 from the insulator 74 to the exterior wall 54 of the firebox 46.

The electrode 72 of the igniter 70 is electrically connected to an insulated wire 100 in the vicinity of the sidewall 54 of the firebox 46. Preferably said connection is made by a high temperature electrical connector 98. Preferably, the insulated wire 100 enters the firebox through the same hole 52 by which the conduit 24 passes through the wall 54 of the firebox 46. Said connection is preferably made immediately adjacent said opening 52 and is enclosed within a heat shield 102 which is attached to the wall 54 of the firebox 46, as by bolts 104.

The placement of the connector 98 in this location permits the user to replace the complete igniter 70, should it be damaged, without requiring that the structure of the building be entered. At the same time, it permits all of that portion of the ignition apparatus within the firebox 46 to tolerate both the continuous and intermittent high temperatures found therein as by the use of the preferred ceramic insulating beads 96.

As seen in FIG. 1, the insulated wire 100 travels from its connection to the igniter 70 through the wall of the building to the box 56, within which it is connected to an actuator 106. The actuator 106 is operated by a switch such as a momentary contact push button switch 108 thereon. Alternatively, the actuator may be actuated by the knob that operates the valve 26 Access to the actuator for operation of the switch 108 or for the replacement of batteries, etc. within the actuator is attained through the door 68 of the box 56. The actuator 106 is preferably battery powered, with the return ground for the spark being provided by the conduit 24. Alternatively, a piezo sparker or a house-current powered sparker may be used.

Many alternative valving arrangements are encompassed within the scope of the invention. For example, in the embodiment shown in FIG. 2, an additional inlet 110 is provided in the conduit 24 within the box 56 downstream of the valve 26. Said additional inlet 110 is in the form of a coupling 112, such as a quick-release or Coleman tYpe coupling, and includes within it a normally closed valve 114 which is opened only when a cooperating coupler is attached to the coupling 112. A preferred valve 114 for this use is a common Schraeder tire valve.

Figure 2:
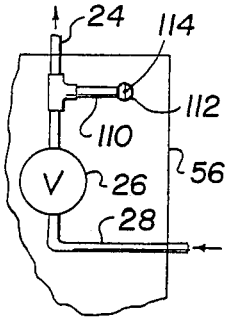
FIG. 2 is an alternative embodiment of the valving of the fireplace starting apparatus of FIG. 1.

The arrangement of FIG. 2 permits the user to select between the use of the invention as described above with an external, replaceable twenty-pound flammable gas canister outside of the building or the use of a one-pound gas canister and hose arrangement as disclosed in my U.S. Pat. No. 4,779,608, which disclosure is expressly incorporated herein.

Figure 3:
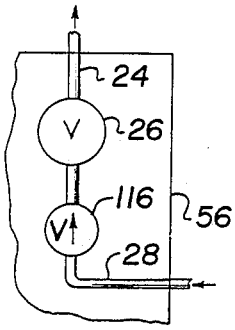
FIG. 3 is a second alternative embodiment of the valving of the fireplace starting apparatus of FIG. 1.

FIG. 3 discloses another alternative embodiment of the valving arrangement which adds an excess pressure check valve 116 to the fire starting apparatus 20 of FIG. 1. Said excess pressure check valve 116 will not permit the passage of flammable gas if the pressure of the gas applied to the valve 116 is too great, as, for example, if the external twenty-pound canister 30 is connected to the second conduit 28 without the use of regulator 60 or if the regulator 60 malfunctions. The excess pressure check valve 116 thus reduces the danger of uncontrolled, excess pressure gas entering the fireplace. Excess pressure check valve 116 does not impede the flow of gas at ordinary pressures. Alternatively, the excess pressure check valve may be located in the fireplace, as between the conduit 24 and the mount 23 or within the mount 23.

Figure 4:
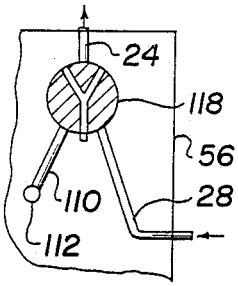
FIG. 4 is a third alternative embodiment of the valving of the fireplace starting apparatus of FIG. 1.

FIG. 4 discloses an additional alternative valving arrangement in which a three-way control valve 118 replaces the control valve 26 of FIG. 1. This three-way control valve 118 allows the user to select between the conduit 26, which may be connected to the external twenty-pound replaceable flammable gas cylinder 30, and the second inlet 110 having the coupling 112, for use with the internal one-pound gas canister and hose arrangement previously described and incorporated.

Figure 5:
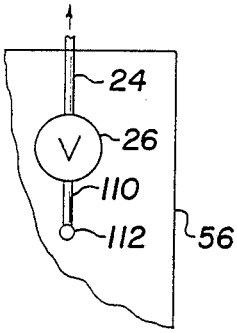
FIG. 5 is a fourth alternative embodiment of the valving of the fireplace starting apparatus of FIG. 1.
Figure 6:
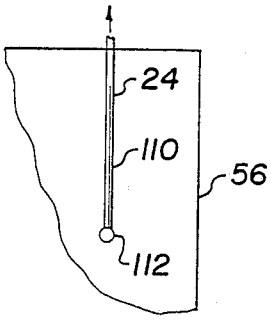
FIG. 6 is a fifth alternative embodiment of the fireplace starting apparatus of FIG. 1 having no control valve.
Figure 7:
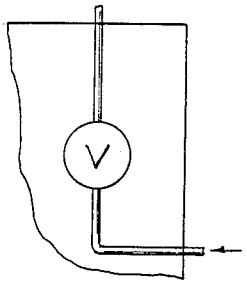
FIG. 7 is an enlarged view of the valving of the fireplace starting apparatus of FIG. 1.

Turning to FIGS. 5 and 6, there are seen two alternative embodiments of the fire starting apparatus in which the flammable gas is supplied from a one-pound replaceable cylinder and hose arrangement as described above. In FIG. 6, the conduit 24 is connected to an inlet 110 which is provided with a coupling 112. In operation, the one-pound cylinder and hose are connected to the coupling 112 by a cooperative coupler. A valve in the cylinder/hose apparatus may be used to control the flow of flammable gas to the burner 22. In the embodiment of FIG. 5, a control valve 26 is also incorporated into the fire starting apparatus of the invention to control the flow of flammable gas to the burner 22.

Figure 8:
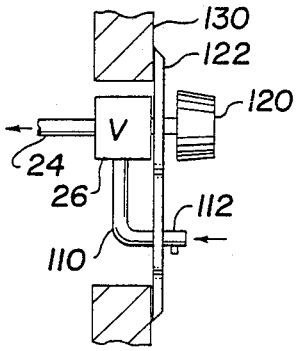
FIG. 8 is a side view of the valving of the fireplace starting apparatus of FIG. 5.
Figure 9:
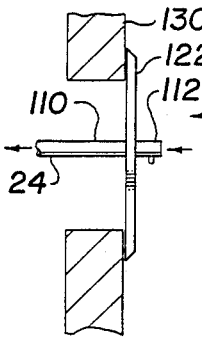
FIG. 9 is a side view of the fireplace starting apparatus of FIG. 6.

FIGS. 8 and 9 embody the arrangements of FIGS. 5 and 6 except that the valve 26 and the coupling 112 are flush mounted at the surface of the wall 130 to a face plate 122 rather than being contained within the wall mounted box 56. The valve 26 of FIG. 8 is provided with a knob 120 which is of the push-to-turn variety, adding an additional element of safety over a turn without pushing valves. The knob 120 of FIG. 8 can be removable.

Figure 10:
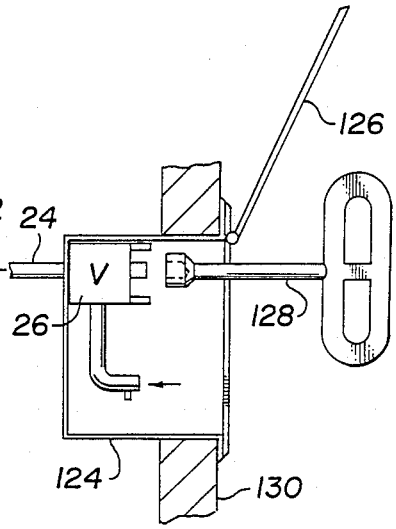
FIG. 10 is an alternative embodiment of the valving of the fireplace starting apparatus of FIGS. and 8.

FIG. 10 discloses a valving arrangement identical to that of FIGS. 5 and 8 wherein the valve 26 and coupling 112 are contained within a wall mounted box 124 provided with a cover 126. The box 124 may be approximately the size of an electrical box. When the cover 126 is opened, a removable key or knob 128 is used to operate the valve 26. When the cover 126 is closed, the apparatus of FIG. 10 is substantially flush with the surface of the wall 30.

Figure 11:
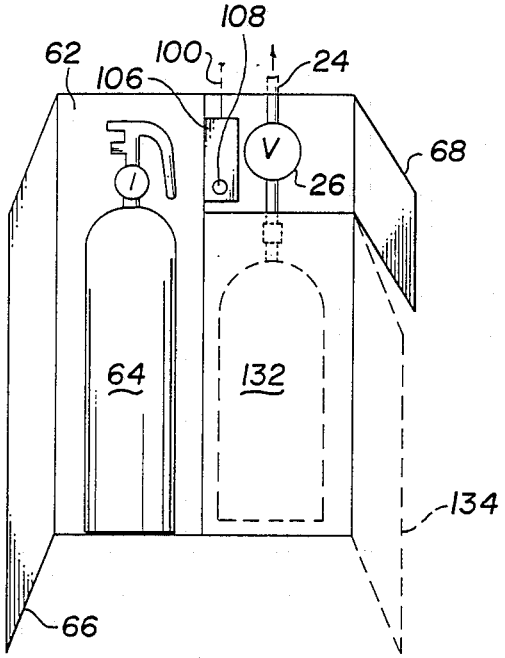
FIG. 11 is an elevation of another alternative embodiment of the fireplace starting apparatus of the invention.
Figure 12:
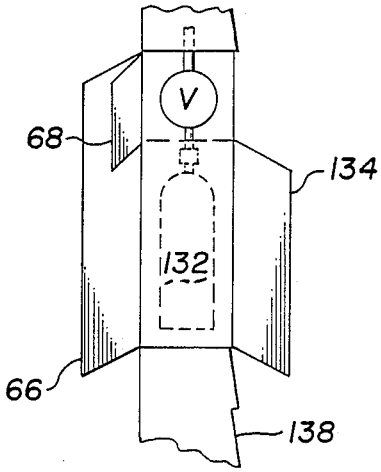
FIG. 12 is a side view of the embodiment of FIG. 11.

FIGS. 11 and 12 show an alternative embodiment of the fireplace starting apparatus wherein a replaceable flammable gas canister such as a one-pound cylinder 132 is contained within the wall 138 within the box 56. The apparatus of FIGS. 11 and 12 is similar to the box of FIG. 1 except that it additionally includes a volume sufficient to hold a one-pound replaceable cylinder 132. Preferably, the box 56 of FIGS. 11 and 12 is installed in an exterior wall so that the door 66 covering the compartment 62 containing the fire extinguisher 64 or other accessories is accessible from the inside the house adjacent the fireplace 48. Similarly, the door 68 which provides access to the valve 26 and the push button switch 108 of the actuator 106 are also accessible from inside the house. However, the door 134 which provides access to the compartment containing the LP cylinder 132 opens to the outside of the building, so that any gas fumes escaping therefrom are vented to the outside and do not enter the building. A vent 136 as shown in FIG. 1 may be utilized for this same purpose. Alternatively, the door 134 may open to the interior of the building, in which event it is preferably provided with a seal.

Thus, it is apparent that there has been provided, in accordance with the invention, a fireplace starting apparatus that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim:

1. A fireplace starting apparatus, comprising:

a control valve for controlling the flow of flammable gas to a fireplace burner, said control valve being located externally of a firebox of a fireplace with the inlet of said control valve being adapted for connection to a source of flammable gas;

a conduit connectable at one end to a fireplace burner within the firebox and connectable at the other end to the control valve;

a remotely operable ignition device including an igniter mountable within the firebox, an actuator adjacent the control valve and means for operably connecting the actuator to the igniter; and a container adapted for permanent mounting to the structure of a building adjacent the fireplace, said container containing the control valve and the actuator.

2. The apparatus of claim 1 wherein the source of flammable gas is a replaceable canister of flammable gas.

3. The apparatus of claim 2 further including a second conduit adapted to connect said control valve to a flammable gas canister located remotely from said control valve.

4. The apparatus of claim 2 wherein the control valve is switchable between the inlet and a second, separate inlet, with the inlet connectable to a remote, replaceable canister of flammable gas and with the second, separate inlet being connected to a connector adjacent said control valve.

5. The apparatus of claim 4 wherein the apparatus includes a check valve which prevents the flow of gas to said burner when a pressure higher than a preselected maximum pressure is applied to the inlet.

6. The apparatus of claim 5 wherein the high pressure check valve is located in the inlet adjacent the control valve.

7. The apparatus of claim 2 wherein the conduit is provided with a second inlet downstream of the control valve, said second inlet being connected to a connector adjacent said control valve and said second inlet being provided with a check valve, which prevents gas from flowing out of said conduit through said second inlet.

8. The apparatus of claim 7 wherein the check valve permits gas to flow into the conduit through said second inlet only when a cooperating connector is physically connected to the connector adjacent the control valve.

9. The apparatus of claim 3 wherein said container further including an internal first volume sufficient to enclose a replaceable canister of flammable gas and a connector adapted to connect such an enclosed canister to the inlet of the control valve.

10. The apparatus of claim 9 wherein the container includes a vent port connectable to the atmosphere exterior of the building containing the fireplace.

11. The apparatus of claim 9 wherein the container is adapted for installation in an exterior wall of the building containing the fireplace, with the control valve and actuator being operable from a first side of the container through the interior surface of said wall and the enclosed flammable gas container being replaceable from the opposite side of the container through the exterior surface of said wall.

12. The apparatus of claim 9 wherein the container further encloses a second volume of sufficient size to store a portable fire extinguisher, with said second volume being separate from said first volume and with said second volume being accessible from the first side of the container through the interior wall of said building.

13. The apparatus of claim 9 wherein the container further encloses a second volume of sufficient size to store a portable fire extinguisher.

14. The apparatus of claim 13 wherein the second volume is separate from the first volume and the second volume is accessible through the interior wall of said building.

15. The apparatus of claim 1 wherein the container further encloses a volume of sufficient size to store a handheld fire extinguisher.

16. The apparatus of claim 1 wherein the apparatus includes a check valve in the flow path of the flammable gas, the check valve preventing the flow of gas to the burner when a pressure higher than a preselected maximum is applied to the conduit.

17. The apparatus of claim 1 further including means for shutting off the flow of gas to said burner after the expiration of a preselected period of time.

18. The apparatus of claim 1 where the means operably connecting the actuator to the igniter is an electrically conductive cable.

19. The apparatus of claim 1 wherein the igniter includes a continuous electrically conductive electrode with a first end of said electrode adjacent the burner; and a second end of said electrode exterior of the firebox; said igniter further including an electrically non-conductive ceramic insulator fixed to and about said electrode at a point intermediate said ends.

20. The apparatus of claim 19 wherein the igniter further includes a plurality of electrically non-conductive ceramic insulating beads about said electrode between said insulator and said second end, with said beads being in a close fitting relationship to each other so as to function as a substantially continuous ceramic insulation about said electrode.

21. The apparatus of claim 1 further including a mount having two passages therethrough, with the first of said passages fluidly communicating said conduit exterior of said firebox to said burner within said firebox and with the second of said passages being adapted to receive said igniter so that one end of said igniter is within the firebox adjacent said burner and the other end of said igniter is exterior of said firebox.

22. The apparatus of claim 21 wherein the mount is connectable at one end to the exterior wall of the firebox.

23. The apparatus of claim 1 further including a mount having a neck adapted to pass through a knockout hole in the sidewall of a firebox, said mount and said neck thereof having a passage therethrough fluidly communicating said conduit exterior of said firebox to said burner within said firebox, and said mount and said neck providing a space for said igniter to pass through the knockout hole so that one end of said igniter is within the firebox adjacent said burner and the other end of said igniter is exterior of said firebox.

24. A fireplace starting apparatus, comprising:

a control valve for controlling the flow of flammable gas to a fireplace burner, said control valve being located externally of a firebox of a fireplace and being switchable between a first inlet and a second inlet, with the first inlet being adapted for connection to a replaceable canister of flammable gas and with the second inlet being connected to a connector adjacent said control valve;

a conduit connectable at one end to a fireplace burner within the firebox and connectable at the other end to the control valve;

a box adapted for permanent mounting to the structure of a building adjacent the fireplace, said box containing the control valve and the connector of the second inlet; and a second conduit adapted to connect said first inlet to said replaceable canister located remotely from said control valve.

25. The apparatus of claim 24 wherein the apparatus includes a check valve which prevents the flow of gas to said burner when a pressure higher than a preselected maximum pressure is applied to the inlet.

26. The apparatus of claim 25 wherein the check valve is located in the inlet adjacent the control valve.

27. The apparatus of claim 24 wherein the conduit includes an excess pressure check valve located adjacent the control valve, the excess pressure check valve preventing the flow of gas through the conduit when a pressure higher than a preselected maximum is applied to the conduit.

28. The apparatus of claim 24 wherein the container further encloses a volume of sufficient size to store a handheld fire extinguisher.

29. The apparatus of claim 24 further including means for shutting off the flow of gas to said burner after the expiration of a preselected period of time.

30. A fireplace starting apparatus, comprising:

a control valve for controlling the flow of flammable gas to a fireplace burner, said control valve being located externally of a firebox of a fireplace with a first inlet of said control valve being adapted for connection to a replaceable canister of flammable gas;

a conduit connectable at one end to a fireplace burner within the firebox and connectable at the other end to the control valve;

a box adapted for permanent mounting to the structure of a building adjacent the fireplace, said box containing the control valve, and the second inlet;

a second inlet in the conduit downstream of the control valve, said second inlet being connected to a connector adjacent said control valve and said second inlet being provided with a check valve which prevents gas from flowing out of said conduit through said second inlet; and a second conduit adapted to connect said first inlet to said replaceable canister located remotely from said control valve.

31. The apparatus of claim 30 wherein the check valve permits gas to flow into the conduit only when a cooperating connector is physically connected to the connector adjacent the control valve.

32. The apparatus of claim 30 wherein the container further encloses a volume of sufficient size to store a handheld fire extinguisher.

33. The apparatus of claim 30 further including means for shutting off the flow of gas to said burner after the expiration of a preselected period of time.

34. A fireplace starting apparatus, comprising:

a box adapted for permanent mounting to the structure of a building adjacent a fireplace and externally of the firebox thereof, said box having therewithin a first volume of sufficient size to hold a replaceable canister of flammable gas;

a control valve for controlling the flow of flammable gas to a fireplace burner, said control valve being located in the box external of a firebox of the fireplace; with the inlet of said control valve being adapted for connection to a replaceable canister of flammable gas located within the first volume of the box; and a conduit connectable at one end to a fireplace burner within the firebox and connectable at the other end to the control valve.

35. The apparatus of claim 34 said container further including an internal first volume sufficient to enclose a replaceable canister of flammable gas and a connector adapted to connect such an enclosed canister to the inlet of the control valve.

36. The apparatus of claim 34 wherein the container includes a vent port connectable to the atmosphere exterior of the building containing the fireplace.

37. The apparatus of claim 34 wherein the container is adapted for installation in an exterior wall of the building containing the fireplace, with the control valve and actuator being operable from a first side of the container through the interior surface of said wall and the enclosed flammable gas container being replaceable from the opposite side of the container through the exterior surface of said wall.

38. The apparatus of claim 37 wherein the container further encloses a second volume of sufficient size to store a portable fire extinguisher, with said second volume being separate from said first volume and with said second volume being accessible from the first side of the container through the interior wall of said building.

39. The apparatus of claim 34 wherein the container further encloses a second volume of sufficient size to store a portable fire extinguisher.

40. The apparatus of claim 39 wherein the second volume is separate from the first volume and the second volume is accessible through the interior wall of said building.

* * * * *

UNITED STATES PATENT AND TRADEMARK OFFICE

CERTIFICATE OF CORRECTION

PATENT NO. : 4,949,705

DATED : Aug. 21, 1990

INVENTOR(S) : T. Randolph Smith

It is certified that error appears in the above-identified patent and that said Letters Patent is hereby corrected as shown below:

Col. 3, line 23, change "FIGS. and 8" to --FIGS. 5 and 8--

Col. 9, line 13, change "tYpe" to --type--

Signed and Sealed this

Twelfth Day of November, 1991

*Attest:*

HARRY F. MANBECK, JR.

*Attesting Officer*

*Commissioner of Patents and Trademarks*